US010064436B2

(12) United States Patent
Kohrherr et al.

(10) Patent No.: US 10,064,436 B2
(45) Date of Patent: Sep. 4, 2018

(54) GARMENT

(71) Applicant: FITBUMP, New York, NY (US)

(72) Inventors: Kira Kohrherr, New York, NY (US); Daniela Caine, New York, NY (US)

( * ) Notice: Subject to any disclaimer, the term of this patent is extended or adjusted under 35 U.S.C. 154(b) by 178 days.

(21) Appl. No.: 14/832,514

(22) Filed: Aug. 21, 2015

(65) Prior Publication Data

US 2016/0050982 A1 Feb. 25, 2016

Related U.S. Application Data

(60) Provisional application No. 62/040,188, filed on Aug. 21, 2014.

(51) Int. Cl.

| | |
|---|---|
| ***A41D 1/21*** | (2018.01) |
| ***A41C 1/10*** | (2006.01) |
| *A41B 11/14* | (2006.01) |

(52) U.S. Cl.

CPC ..... *A41C 1/10* (2013.01); *A41B 11/14* (2013.01)

(58) Field of Classification Search

CPC ..... A41B 9/001; A41B 11/14; A41D 1/20; A41D 1/062; A41C 1/00; A41C 1/10

USPC ..... 450/220, 221, 236, 237, 227, 228, 74

See application file for complete search history.

(56) References Cited

U.S. PATENT DOCUMENTS

| | | | | |
|---|---|---|---|---|
| 6,276,175 | B1 * | 8/2001 | Browder, Jr. | A41B 9/001 2/409 |
| 7,181,775 | B2 | 2/2007 | Carney | |
| 7,900,276 | B2 * | 3/2011 | Hendrickson | A41D 1/20 2/227 |
| 2004/0210987 | A1 * | 10/2004 | Carney | A41D 1/20 2/236 |
| 2006/0010571 | A1 * | 1/2006 | Oakley | A41D 1/062 2/227 |
| 2008/0172769 | A1 | 7/2008 | Herget | |
| 2008/0244805 | A1 * | 10/2008 | Griffin | A41C 1/00 2/74 |
| 2009/0049583 | A1 | 2/2009 | Stones | |
| 2011/0004976 | A1 | 1/2011 | MacGillivray | |

* cited by examiner

*Primary Examiner* — Gloria Hale

(74) *Attorney, Agent, or Firm* — Michael G. Johnston; Moore & Van Allen PLLC

(57) ABSTRACT

A garment portion comprises a flexible resilient belly panel portion adapted to substantially conform to and cover a wearer's belly. The belly panel portion extends from an upper edge portion below the wearer's breast area and over the wearer's abdomen to a lower edge portion below the wearer's waist. A waistband is selectively connected with the lower edge portion of the belly panel. The belly panel portion is removably attached to the waistband.

10 Claims, 9 Drawing Sheets

GARMENT

CROSS REFERENCES

This application is related to U.S. provisional application No. 62/040,188, filed Aug. 21, 2014, entitled "GARMENT", naming Kira Kohrherr and Daniela Caine as the inventors. The contents of the provisional application are incorporated herein by reference in their entirety, and the benefit of the filing date of the provisional application is hereby claimed for all purposes that are legally served by such claim for the benefit of the filing date.

BACKGROUND

A garment is described for use during pregnancy and, more particularly, a garment which may be modified for use after pregnancy.

Maternity clothing is generally purchased and worn by women during the term of their pregnancies. Most maternity garments are constructed with an elastic belt or waistband, which allows the use of regular clothing as maternity garments by accommodating any increase in waistline size. Some of the garments have stretchable fabric panels or inserts sewn into place. Such garments are difficult to keep in place as they gradually slip downward while they are being worn due to elastic stretching of the panels or inserts pressing against the torso. This is especially true during periods of activity.

Maternity clothing can be very expensive and is typically worn for only a few short months. After the child is born, the maternity clothing is no longer used as the body returns to its pre-pregnancy shape.

For the foregoing reasons, there is a need for a garment that provides both function and comfort during the maternity period and the post-maternity period. The new garment will comfortably fit a growing abdomen during all stages of pregnancy. Ideally, the garment will also function well during periods of high activity.

SUMMARY

A garment portion is provided and comprises a flexible resilient belly panel portion adapted to substantially conform to and cover a wearer's belly. The belly panel portion extends from an upper edge portion below the wearer's breast area and over the wearer's abdomen to a lower edge portion below the wearer's waist. A waistband is selectively connected with the lower edge portion of the belly panel. The belly panel portion is removably attached to the waistband.

A method is also provided for accommodating changes in a shape of a woman during pregnancy with a garment. The shape accommodating method comprises the steps of providing a garment including a flexible resilient belly panel portion adapted to substantially conform to and cover a wearer's belly when worn around a torso. The belly panel portion extends from an upper edge portion about below the wearer's breast area and over the wearer's abdomen to a lower edge portion below the wearer's waist. A waistband is selectively connected with the lower edge portion of the belly panel. Means are provided for removably attaching the belly panel portion to the waistband. The method further comprises the steps of placing the belly panel portion over a wearer's torso and stretching the belly panel portion such that the upper edge portion of the belly panel is about below the wearer's breast area and the belly panel extends over the wearer's abdomen to a lower edge portion below the wearer's waist. The belly panel portion is worn stretched over the belly to accommodate the swelling of pregnancy. The belly panel portion may be detached from the waistband to provide a garment having a configuration for use as a non-maternity garment post pregnancy.

BRIEF DESCRIPTION OF THE DRAWINGS

For a more complete understanding of the garment, reference should now be had to the embodiments shown in the accompanying drawings and described below. In the drawings.

DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the FIGs. Indeed, the components may be oriented in any direction and the terminology, therefore, should be understood as encompassing such variations unless specified otherwise.

Figure 1:
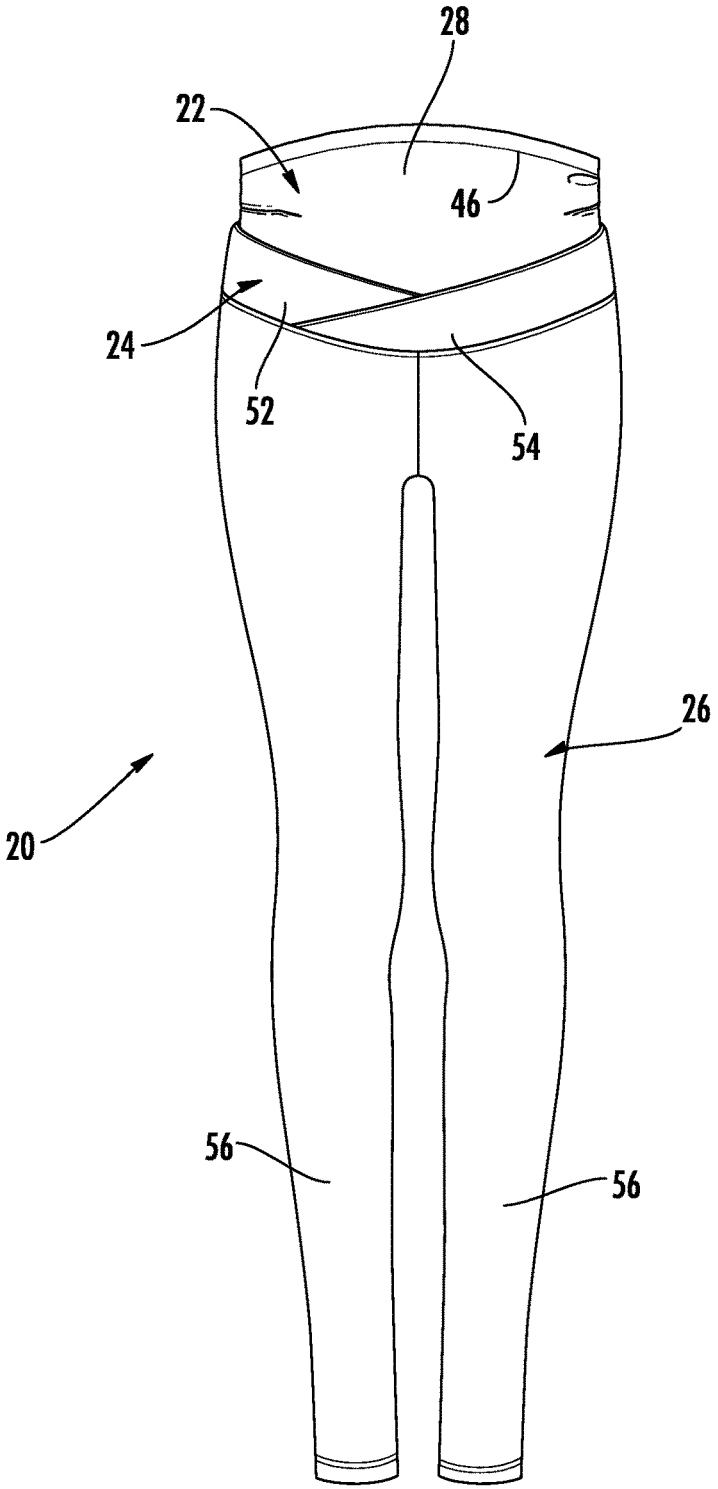
FIG. 1 is a front elevation view of an embodiment of a garment for use during and after pregnancy.
Figure 2:
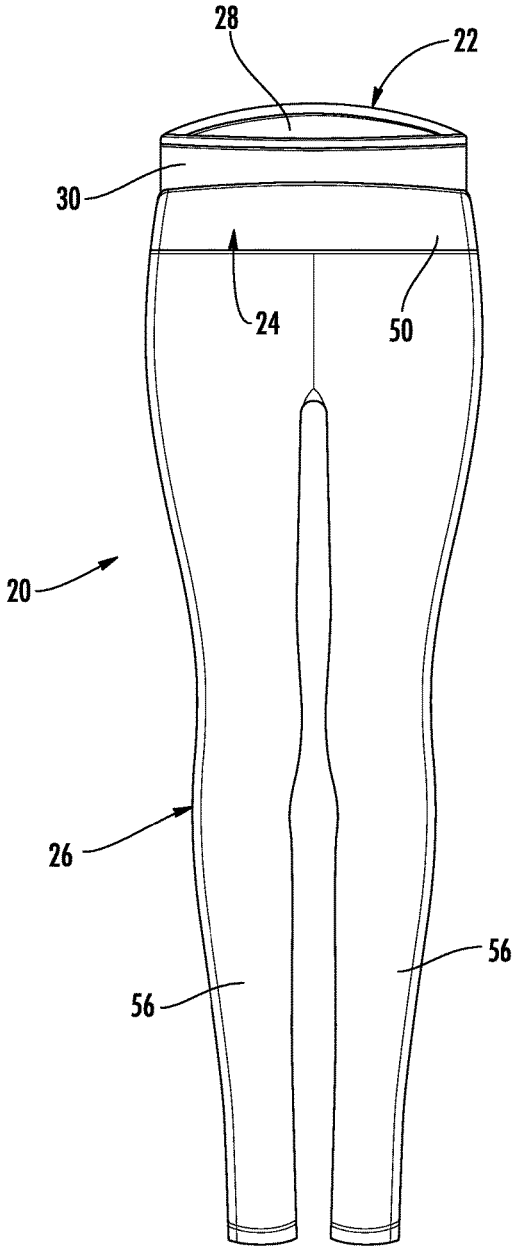
FIG. 2 is a rear elevation view of the garment as shown in FIG. 1.
Figure 3:
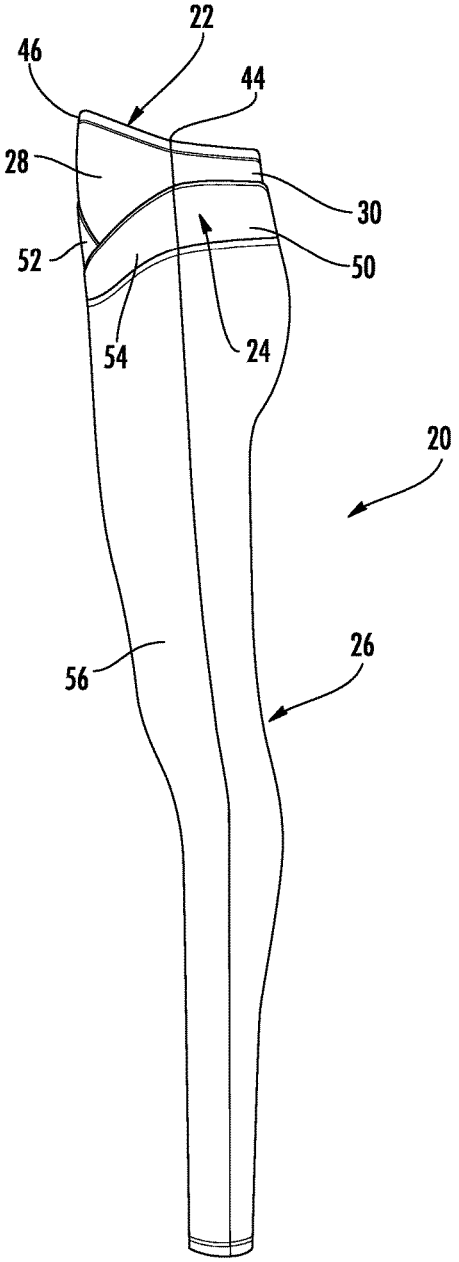
FIG. 3 is a left side elevation view of the garment as shown in FIG. 1.

Referring now to FIGS. 1-3, wherein like reference numerals designate corresponding or similar elements throughout the several views, a garment for use during pregnancy is described and generally designated at 20. In one embodiment, the garment 20 is convertible and may be configured to allow a woman to use the garment as a maternity garment during pregnancy and as a non-maternity garment during pre- or post-pregnancy periods. The garment 20 comprises a maternity band 22, or panel, operatively connected to a waistband 24 which, in turn, is connected to a bottom portion 26 or component. The maternity band 22 covers the abdomen of a woman and functions for maternity use when the garment 20 is worn during pregnancy. The maternity band 22 is removable for use and wear of the garment 20 after pregnancy.

Figure 4:
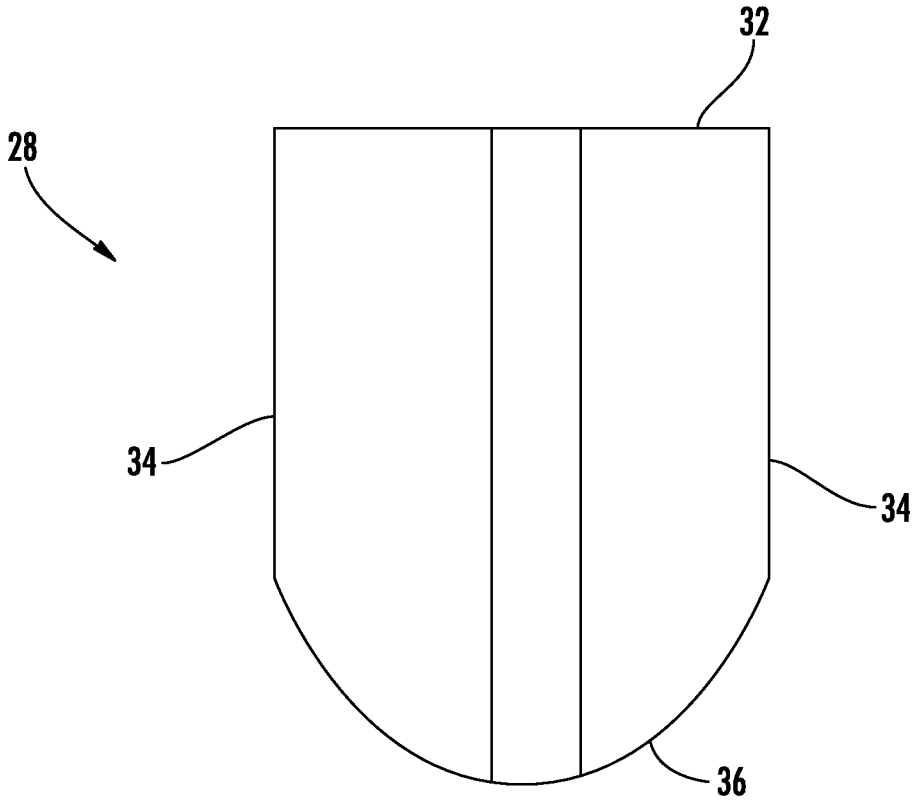
FIG. 4 is a schematic elevation view of a front compression panel for use in the garment as shown in FIG. 1.
Figure 5:
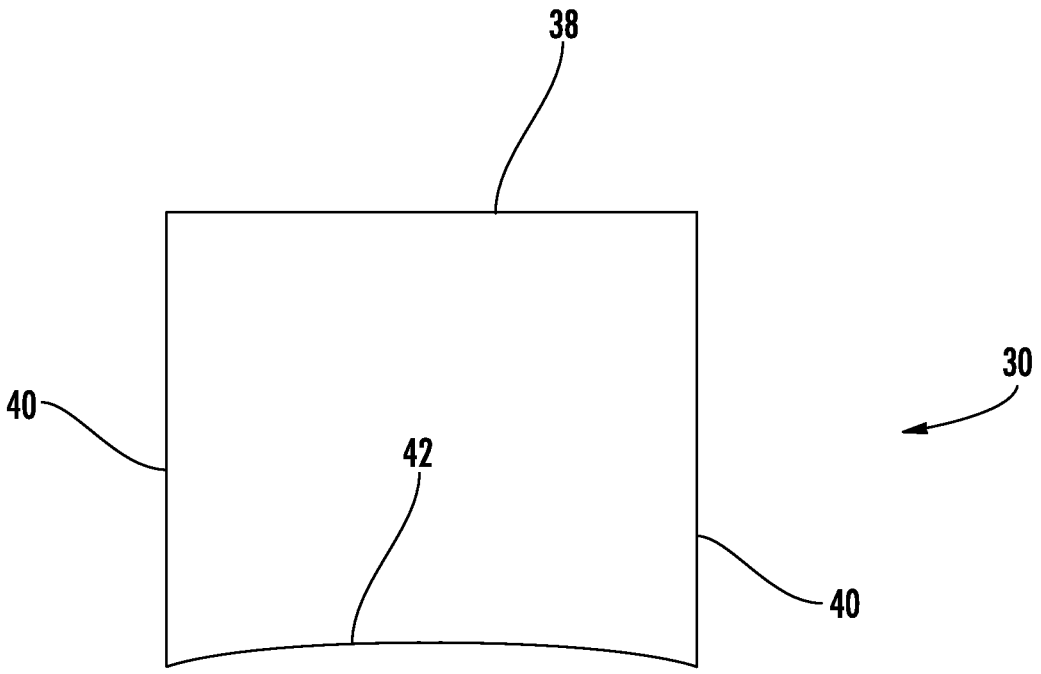
FIG. 5 is a schematic elevation view of a back compression panel for use in the garment as shown in FIG. 1.

Referring to FIGS. 4 and 5, the maternity band 22 comprises a front compression panel 30 and a back compression panel 30. The front compression panel 30 has a linear top edge 32 and side edges 34 and a downwardly curved bottom edge 36. The longest dimension of the front compression panel 30 extending from the top edge 32 to the bottom edge 36 along a central longitudinal axis is from about 10 inches to about 13 inches. The back compression panel 30 also has a linear top edge 38 and side edges 40 and an upwardly curved bottom edge 42. The shortest dimension along a central longitudinal axis of the back compression panel 30 is about 4 inches to about 6 inches. The length of the side edges 40 of both the front compression panel 30 and the back compression panel 30 is about 5 inches to about 8 inches.

The side edges 34, 40 of the front compression panel 28 and the back compression panel 30 are joined with sewn seams 44 forming a tubular, straight-sided cylinder having substantially straight sides. The fabric adjacent the sides 34 of the front compression panel 28 is gathered longitudinally prior to sewing the seams 44. The side seams 44 extend continuously from the top to the bottom of the maternity band 22. When assembled, the width of the maternity band 22 along the top edge is about 11 inches to about 17 inches, which will accommodate a pregnant woman of a designated size range. Because the garment 20 comprises an elastically stretchable material, the garment 20 can be designed such that a single size fits a particular pregnant woman throughout the entire period of time when she cannot wear her normal clothing. Different sizes can be provided for different sizes of women.

The maternity band 22 is sufficiently long so as to extend above the location of maximum girth of the abdomen, even during later stages of pregnancy, such that the upper portion of the maternity band 22 resists slipping down over the abdomen. The top edges 32, 38 of the maternity band 22 of the garment 20 may also have a top perimeter hem 46 made by folding over a margin of the fabric and sewing the folded fabric to the inside surface of the maternity band 22 to create the hem 46. The maternity band 22 may include one or more elastic bands 48 disposed within all, or at least a substantial portion of, the hem 46 of the maternity band 22. The elastic bands 48 may be sewn in place between the two layers of the doubled fabric.

The maternity band 22 may be woven or knitted from known commercially available elastically stretchable materials, including, for example, materials which are substantially flexible for accommodating the shape of the wearer. Exemplary elastically stretchable materials used to construct the maternity band 22 may include stretchy knit, spandex (also referred to as "elastane") and combinations thereof, or other suitable elastically stretchable materials. In one embodiment, the maternity band is a blend of 90% nylon and 10% lycra spandex. The maternity band 22 may be constructed from a single layer of fabric, or alternatively, multiple layers of material may be used. Examples of multilayer configurations include bonding of fabric layers, such as, for example, with a fabric adhesive, sewing, or other suitable attachment mechanisms.

The elastically stretchable material may be configured to help the maternity band 22 expand to accommodate changes in a woman's belly during pregnancy. The characteristics of the maternity band 22, including the shape and construction, allow the maternity band 22 to expand to cover and fit over a growing abdomen during different stages of pregnancy. Further, the stretchable fabric is contractible elastically to cover a shrinking abdomen during different stages of postpartum body changes. In addition, the elastically stretchable material may be sized and configured to provide a relatively snug or secure compression fit, which may help support the belly or back.

The waistband 24 of the garment 20 comprises three pieces, a back portion 50, a right front portion 52 and a left front portion 54 which, together, encircle the waist and hips of a wearer (FIGS. 1-3). The configuration of the three-piece waistband 24 improves the fit of the garment 20 throughout the pregnancy and provides a good yield in terms of fabric consumption. Moreover, the pattern pieces 50, 52, 54 reflect the decrease in hip circumference from bottom to top.

Figure 6:
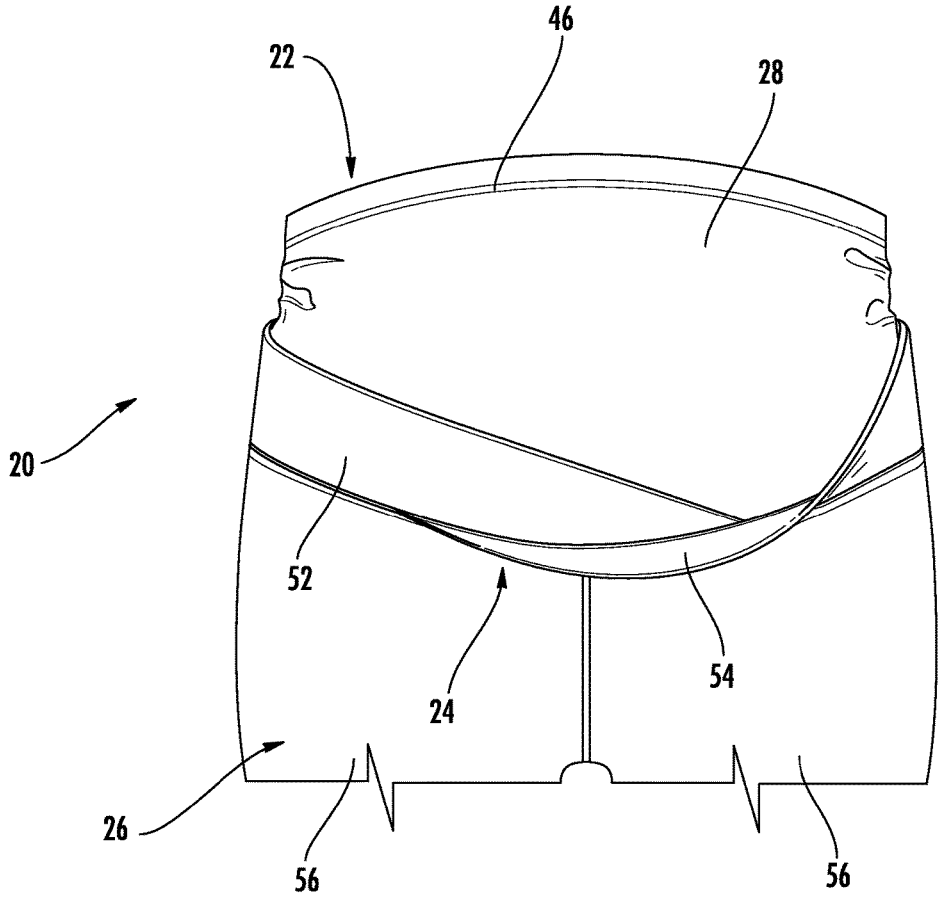
FIG. 6 is a close-up front elevation view of the garment as shown in FIG. 1 with a portion of a waistband moved aside.
Figure 7:
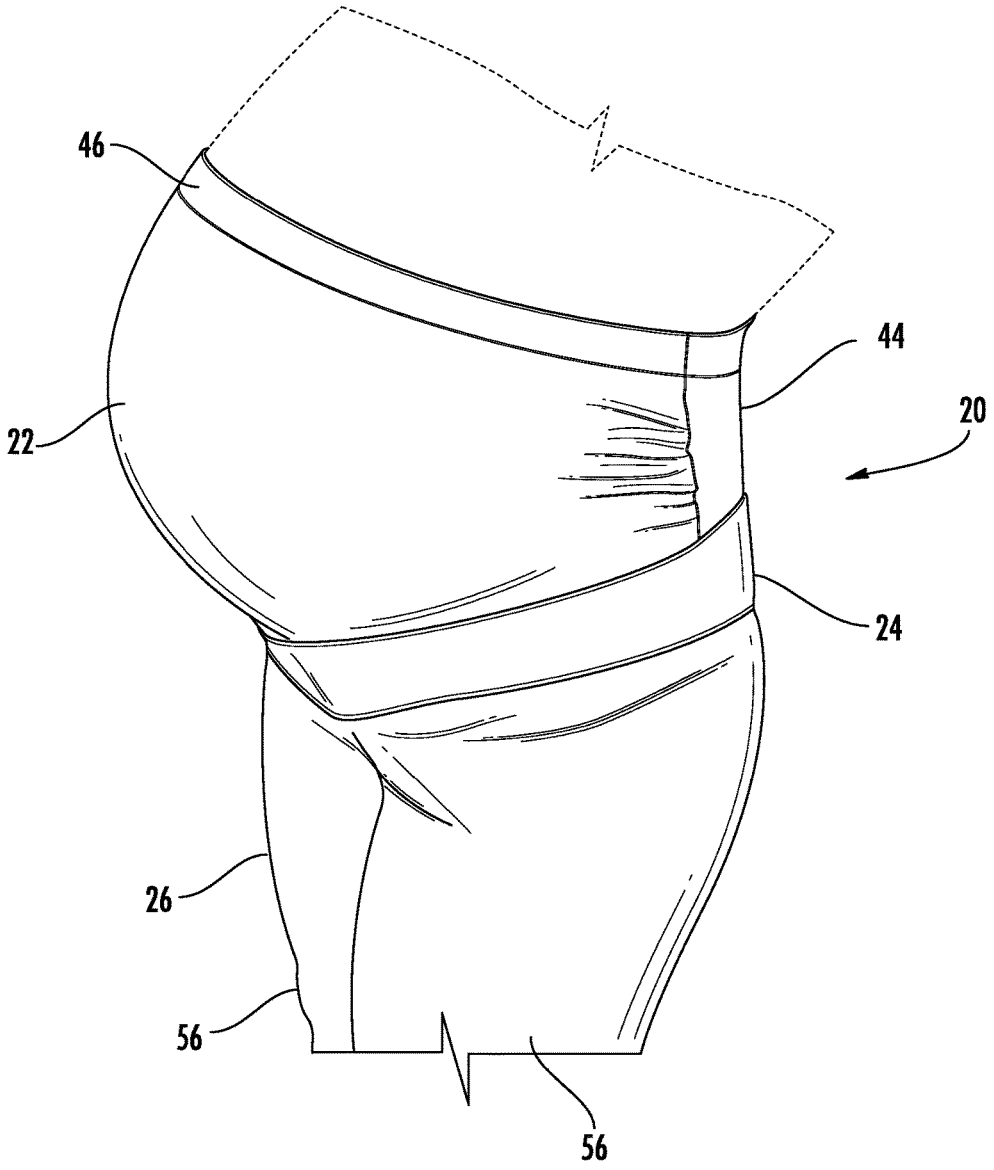
FIG. 7 is a close-up front perspective view of the garment showing a torso of a woman wearing the garment as shown in FIG. 1
Figure 8:
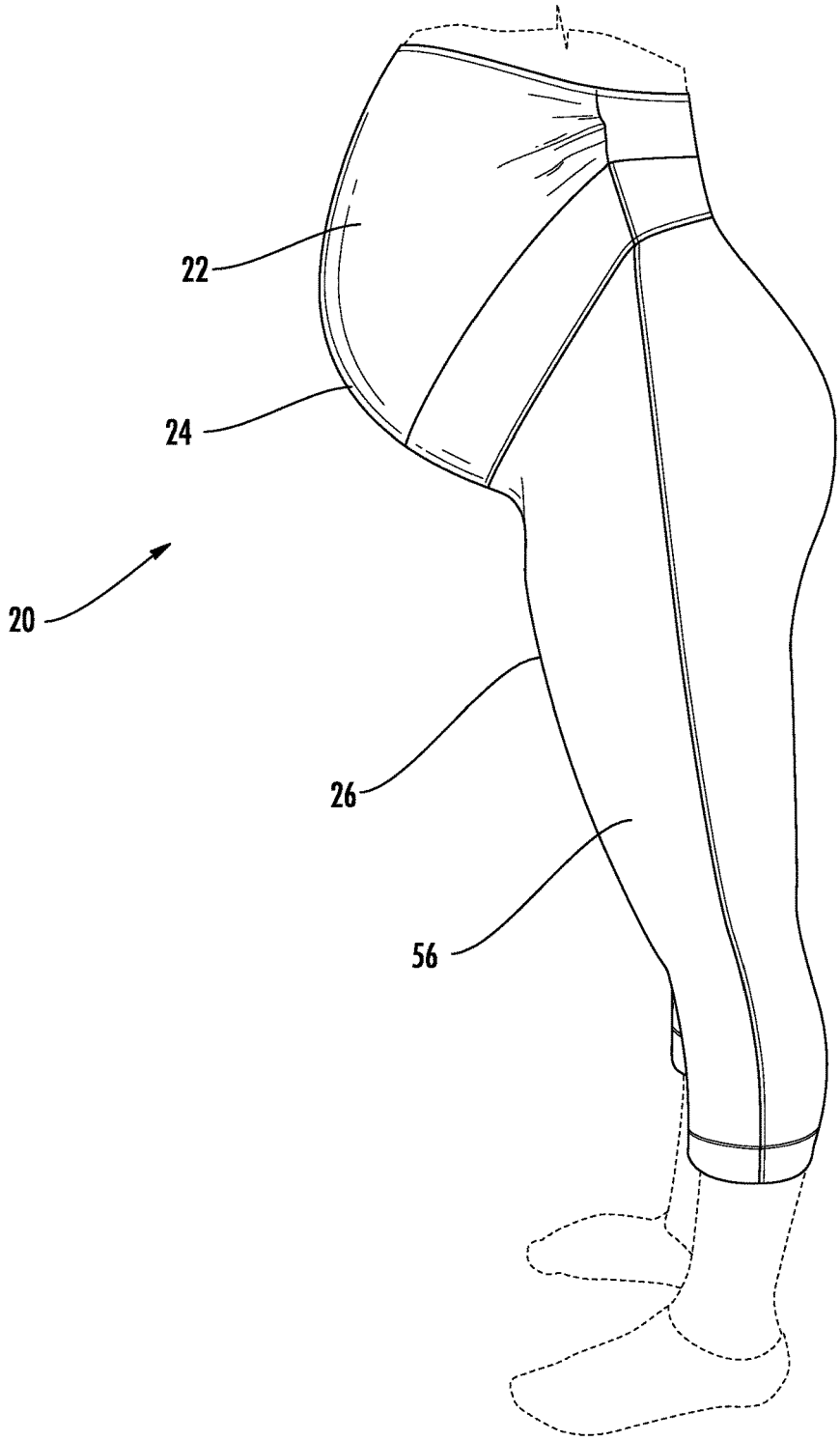
FIG. 8 is a left side elevation view of a torso of a woman wearing the garment as shown in FIG. 7.
Figure 9:
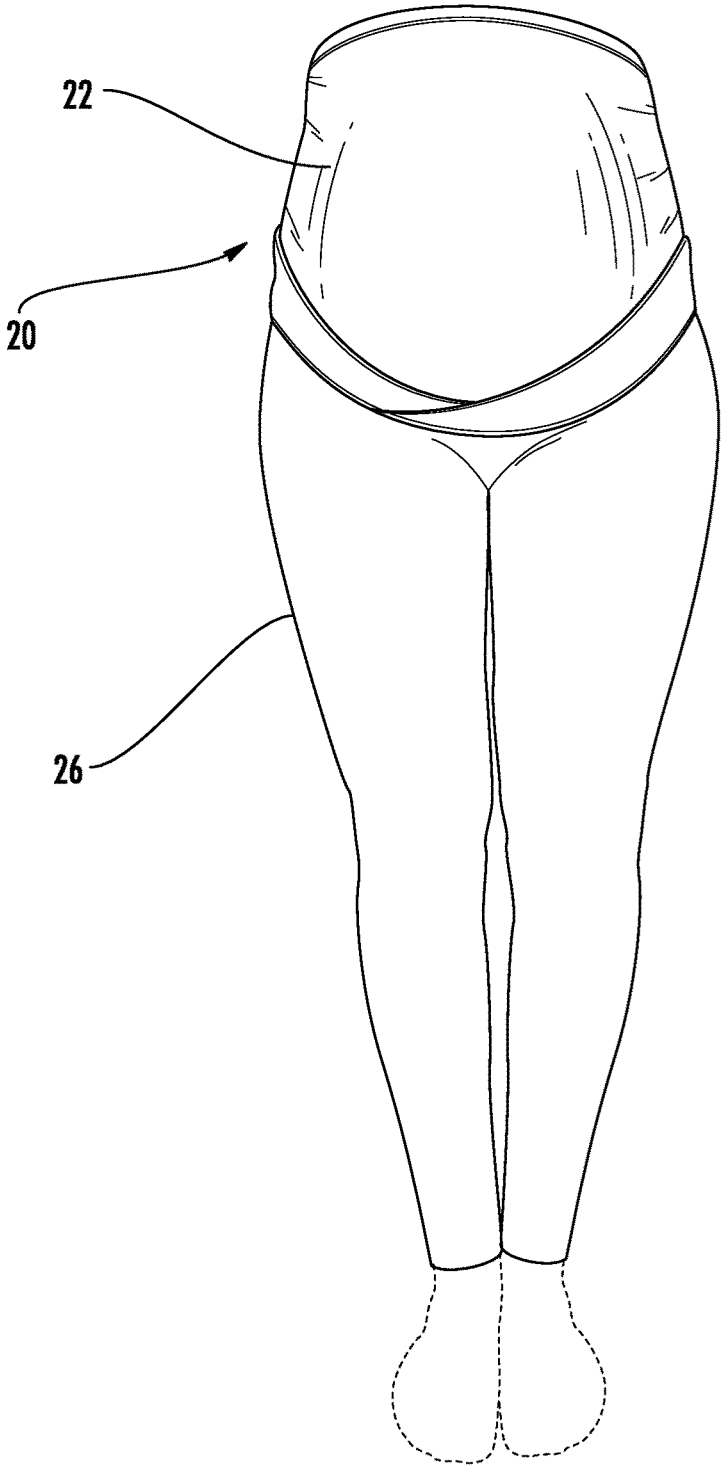
FIG. 9 is a front elevation view of a body of a woman wearing the garment as shown in FIG. 7.
Figure 10:
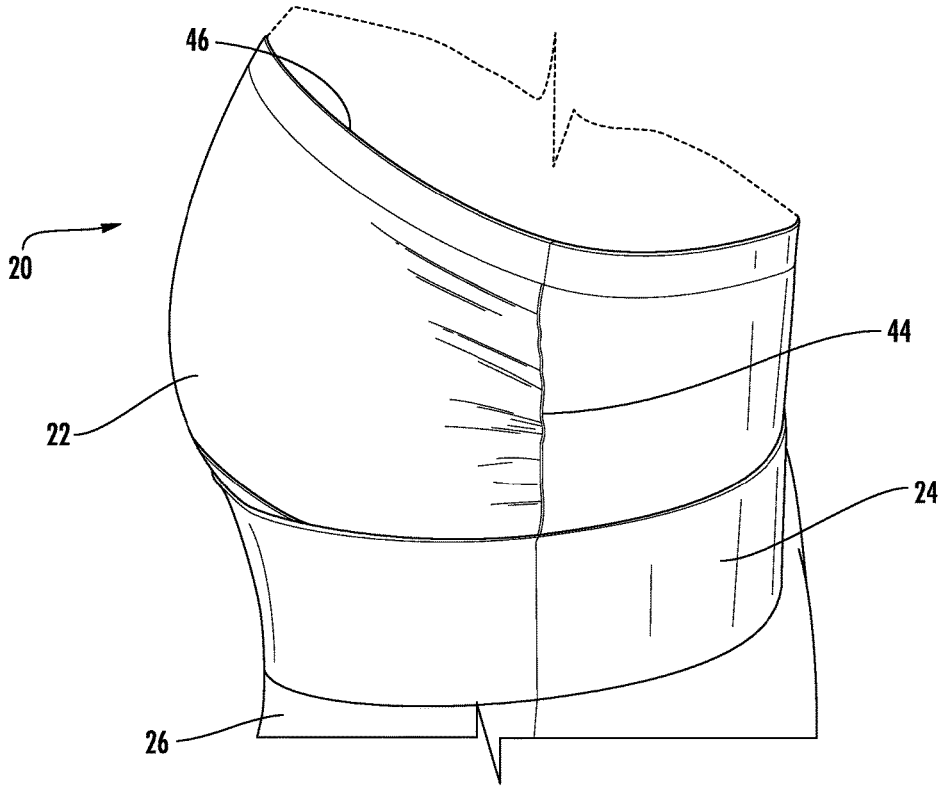
FIG. 10 is close-up a left side elevation view of a torso of a woman wearing the garment as shown in FIG. 7.

In one embodiment, the width of the waistband 24 is at least about four inches to about six inches. Each of the ends of the back portion 50 of the waistband 24 is sewn to one of the ends of the right front portion 52 or the left front portion 54. The waistband 24 extends downwardly from these connections toward the front center point of the waistband and is generally straight across the back (FIG. 6). This configuration shapes the waistband 24 with a downward curvature across a lower pelvis of a wearer, which provides room for expansion of the maternity band 22 when covering a growing abdomen during various stages of pregnancy.

The waistband 24 may comprise any material with stretchable characteristics such as, for example, nylon, elastane, rayon, elastic, spandex, knitted cotton, jersey knit, ribbed material or any other suitable expandable and contractible material.

The maternity band 22 is removably attached to the waistband 24 in the area proximate to the bottom edge of the maternity band 22 and the top edge of the waistband 24. In one embodiment, the perimeter of the bottom edge 36 of the maternity band 22 is sewn to the corresponding upper edge perimeter of the waistband 24 using stitching, which secures the maternity band to the waistband. When joined, the side seams 44 of the maternity band 22 are aligned with the side seams of the waistband 24. The waistband 24, in turn, is attached to the remainder of the bottom component 26 of the garment 20 to form a pair of leggings, or other article of clothing.

The maternity band 22 is connected to the waistband 24 along a line of connection at or near the hips of the wearer. Since the wearer is a pregnant woman, the maternity band 22 and the waistband 24 may be sized and configured to be connected along a connection line at, or below, the belly of a wearer of the garment 20. This arrangement may advantageously help an expandable maternity band 22 accommodate the pregnant woman's belly as it expands during her pregnancy. The line of connection, which in this embodiment is stitching, may be at least partially hidden or may form part of a design element of the article of clothing. When hidden, the stitching may be along the interior surface and below the top edge of the waistband 24 such that the top edge of the waistband 24 may at least partially abut or overlap the bottom edge 36 of the maternity band 22 to cover all or at least a substantial portion of the line of connection It is understood that the connection of the maternity band 22 and the waistband 24 may be made by means other than stitching, including, for example, at least a portion of one or more zippers, buttons, snaps, hooks, hook-and-loop fasteners (e.g. Velcro), or any suitable fastening means for connecting the maternity band 22 to the waistband 24.

In the embodiment of the garment 20 shown in the FIGs. the bottom portion 26 is configured so as to form a pair of leggings when engaging the maternity band 22 and the waistband 24. Each leg 56 of the leggings is constructed in a conventional manner. It is understood that, although leggings are shown herein as a bottom portion of the garment 20, the bottom portion may be any suitable article of clothing as a component, including, but not limited to, a skirt or a pair of pants, such as jeans, slacks, shorts, capris and the like, or other suitable article of clothing.

Referring to FIGS. 7-10, the garment 20 is initially worn with the maternity band 22 during pregnancy. The maternity band 22 generally surrounds all, or at least a portion of, a pregnant woman's torso or midsection and expands to accommodate the growth of the belly during pregnancy. Accordingly, the maternity band 22 is configured to function with the waistband 24 when the garment 20 is used in a first maternity configuration. In addition, the maternity band 22 is configured to provide a relatively snug or secure fit on the belly.

The garment 20 is selectively convertible from a garment for use during pregnancy to a second non-maternity garment configuration. The result is a fully functional garment 20 to wear post-pregnancy. The conversion is carried out by removing the maternity band 22 such that the waistband 24 forms a top portion of the garment 20. In one embodiment, the maternity band 22 is removable by cutting, such as with a pair of scissors, the maternity band adjacent to the line of connection with the waistband 24. As shown in FIG. 6, a cut line may be marked on the fabric of the maternity band to direct the user where to cut. Alternatively, the conversion may be accomplished by releasing or unfastening the stitching connecting the maternity band 22 to the waistband 24. In any case, removal of the maternity band 22 should be accomplished in a manner that maintains the integrity of the waistband 24 and without damage to the bottom portion 26 of the garment 20.

The garment 20 as described herein has many advantages, including providing, in a first condition, a maternity garment configured to be worn by a woman during her maternity term, The maternity garment 20 fits comfortably and adapts to cover a growing abdomen during pregnancy. Moreover, the maternity garment 20 is configured to stay up, even when worn over different and expanding body types. In a second condition, the garment 20 is configured and arranged as a non-maternity garment, which is form from a portion of the garment 20 in the first condition to provide the garment for non-maternity use. Thus, the garment 20 may be used during maternal stages, or periods of expanding waistlines, and afterwards as a part of the regular, non-maternal wardrobe.

Although the garment has been shown and described in considerable detail with respect to only a few exemplary embodiments thereof, it should be understood by those skilled in the art that we do not intend to limit the garment to the embodiments since various modifications, omissions and additions may be made to the disclosed embodiments without materially departing from the novel teachings and advantages of the garment, particularly in light of the foregoing teachings. Accordingly, we intend to cover all such modifications, omission, additions and equivalents as may be included within the spirit and scope of the garment as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. A garment for receiving at least a wearer's mid-body including between just below a breast area and a wearer's waist for covering the wearer's belly, the garment comprising:

a flexible resilient expandable belly panel portion adapted to substantially conform to and cover the wearer's belly, the belly panel portion having an upper edge portion and a lower edge portion and configured to extend from the upper edge portion below the wearer's breast area and over the wearer's abdomen to the lower edge portion below the wearer's waist, the belly panel portion including a front panel having an upper edge, a lower edge, a length from the upper edge to the lower edge, and sides extending between and interconnecting the upper edge and the lower edge, and a back panel having an upper edge, a lower edge, a length from the upper edge to the lower edge, and sides extending between and interconnecting the upper edge and the lower edge, wherein the front panel and back panel are joined along their sides forming side seams, and wherein the length of the front panel is greater than the length of the back panel such that the fabric of the front panel is gathered along the side seams;

a waistband selectively connected with the lower edge portion of the belly panel; and means for removably attaching the belly panel portion to the waistband, wherein said belly panel portion is configured to expand or contract to cover the wearer's belly during different stages of pregnancy up to full term and post-delivery.

2. The garment as recited in claim 1, further comprising a pair of legs attached to the waistband.

3. The garment as recited in claim 1, wherein the belly panel portion is elastically expansible and contractible and allows for belly size increase or decrease.

4. The garment as recited in claim 1, wherein the upper edge portion of the belly panel is folded over and sewn for forming a tubular passage, and an elastic stretchable band disposed within the passage.

5. The garment as recited in claim 1, wherein the belly panel portion comprises a tubular structure.

6. The garment as recited in claim 1, wherein the lower edge portion of the belly panel portion is proximate to the means for removably attaching the belly panel portion to the waistband.

7. The garment as recited in claim 1, wherein the means for removably attaching is stitching.

8. The garment as recited in claim 1, wherein the waistband is configured to overlap and cover the lower edge portion of the belly panel portion.

9. A method for accommodating changes in a shape of a woman wearer during pregnancy with a garment, the shape accommodating method comprising the steps of:

providing a garment including a flexible resilient expandable belly panel portion adapted to substantially conform to and cover the wearer's belly, the belly panel portion having an upper edge portion and a lower edge portion and configured to extend from the upper edge portion below the wearer's breast area and over the wearer's abdomen to the lower edge portion below the wearer's waist, the belly panel portion including a front panel having an upper edge, a lower edge, a length from the upper edge to the lower edge, and sides extending between and interconnecting the upper edge and the lower edge, and a back panel having an upper edge, a lower edge, a length from the upper edge to the lower edge, and sides extending between and interconnecting the upper edge and the lower edge, wherein the front panel and back panel are joined along their sides forming side seams, and wherein the length of the front panel is greater than the length of the back panel such that the fabric of the front panel is gathered along the side seams;

a waistband selectively connected with the lower edge portion of the belly panel, and means for removably attaching the belly panel portion to the waistband;

placing the belly panel portion over a wearer's torso and stretching the belly panel portion such that the upper edge portion of the belly panel is about below the wearer's breast area and the belly panel extends over the wearer's abdomen to a lower edge portion below the wearer's waist;

wearing the belly panel portion stretched over the belly to accommodate the swelling of pregnancy; and detaching the belly panel portion from the waistband to provide a garment having a configuration for use as a non-maternity garment post pregnancy.

10. The shape accommodating method as recited in claim 9, wherein the waistband is configured to overlap and cover the lower edge portion of the belly panel portion.

* * * * *